United States Patent [19]

Neumann

[11] Patent Number: 4,514,113

[45] Date of Patent: Apr. 30, 1985

[54] EARTH RETAINING WALL SYSTEM

[76] Inventor: Albert Neumann, 5401 Graywing Ct., Columbia, Md. 21045

[21] Appl. No.: 517,639

[22] Filed: Jul. 27, 1983

[51] Int. Cl.[3] ..... E02D 29/02; E02D 17/00

[52] U.S. Cl. ..... 405/286; 405/262; 405/284

[58] Field of Search ..... 405/258, 262, 272, 284, 405/285, 286, 287, 15; 403/252, 254; 52/166, 542, 588

[56] References Cited

U.S. PATENT DOCUMENTS

| | | | |
|---|---|---|---|
| 3,421,326 | 1/1969 | Vidal | 405/284 |
| 3,686,873 | 8/1972 | Vidal | 405/262 |
| 3,922,864 | 12/1975 | Hilfiker | 405/286 X |
| 4,116,010 | 9/1978 | Vidal | 405/286 X |
| 4,260,296 | 4/1981 | Hilfiker | 405/284 |
| 4,266,890 | 5/1981 | Hilfiker | 405/262 X |
| 4,341,491 | 7/1982 | Newmann | 405/262 X |
| 4,343,571 | 8/1982 | Price | 405/284 |

FOREIGN PATENT DOCUMENTS

| | | | |
|---|---|---|---|
| 2348043 | 8/1974 | Fed. Rep. of Germany | 405/286 |
| 1000514 | 10/1951 | France | 405/284 |

*Primary Examiner*—Cornelius J. Husar
*Assistant Examiner*—Nancy J. Stodola
*Attorney, Agent, or Firm*—Morton J. Rosenberg

[57] ABSTRACT

An earth retaining wall system (10) which includes a frontal wall (22) formed of a plurality of hexagonally contoured frontal wall panel members (24) having predetermined spatial coordinate locations. A coupling mechanism (28) includes a plurality of longitudinally extending tension bar members (64 and 64') which pass in contiguous contact with a multiplicity of anchor block members (26 or 26') longitudinally displaced from frontal wall (22) and embedded within earth mass (18). Tension bar members (64 and 64') are fixedly secured to individual frontal wall panel members (24). The earth retaining wall system (10) provides for a stable structure to maintain an earth mass (18) in constrained relation behind frontal wall (22).

20 Claims, 8 Drawing Figures

FIG. 3
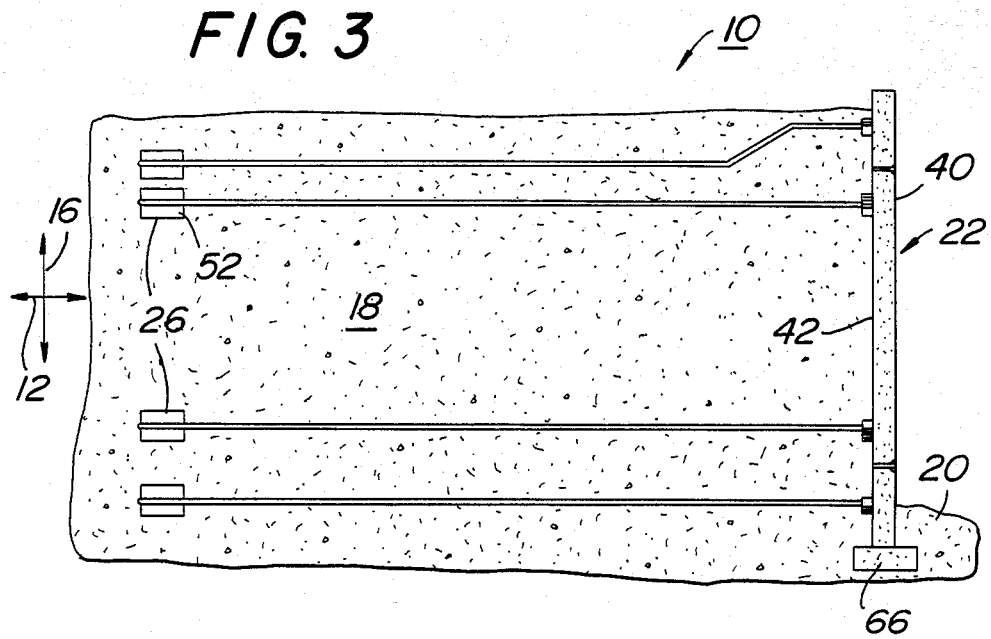
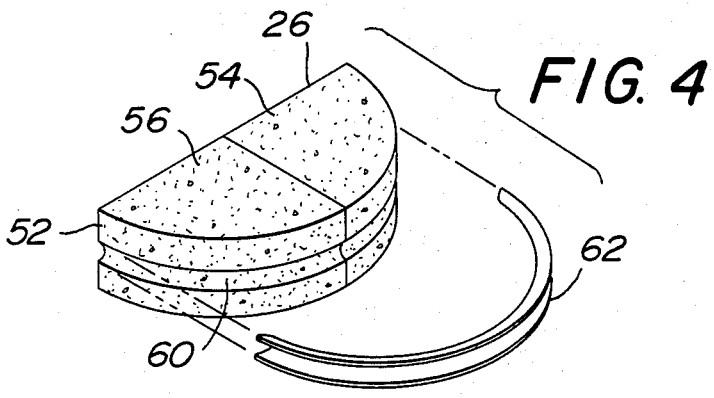
FIG. 4
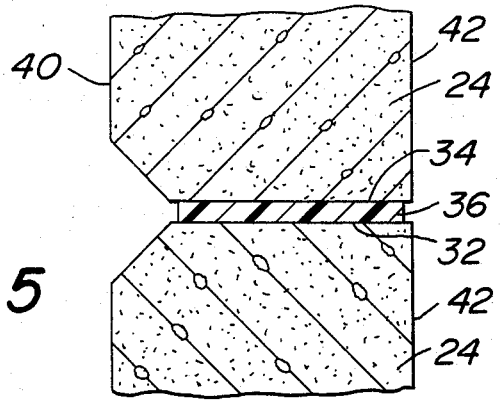
FIG. 5

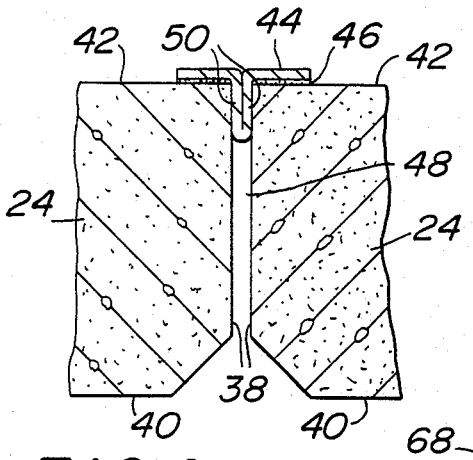
FIG. 6
FIG. 7
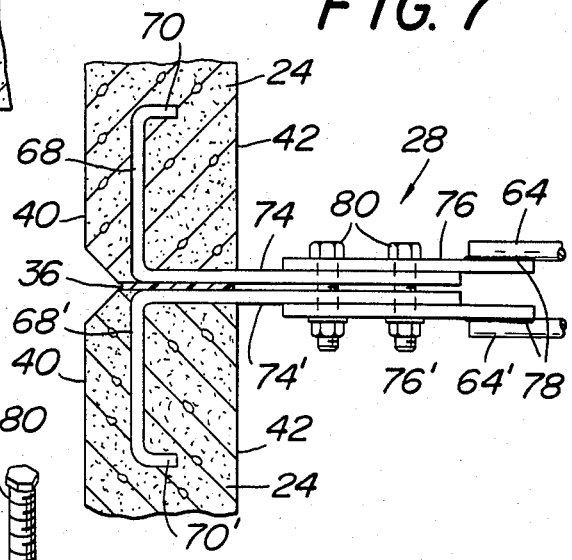
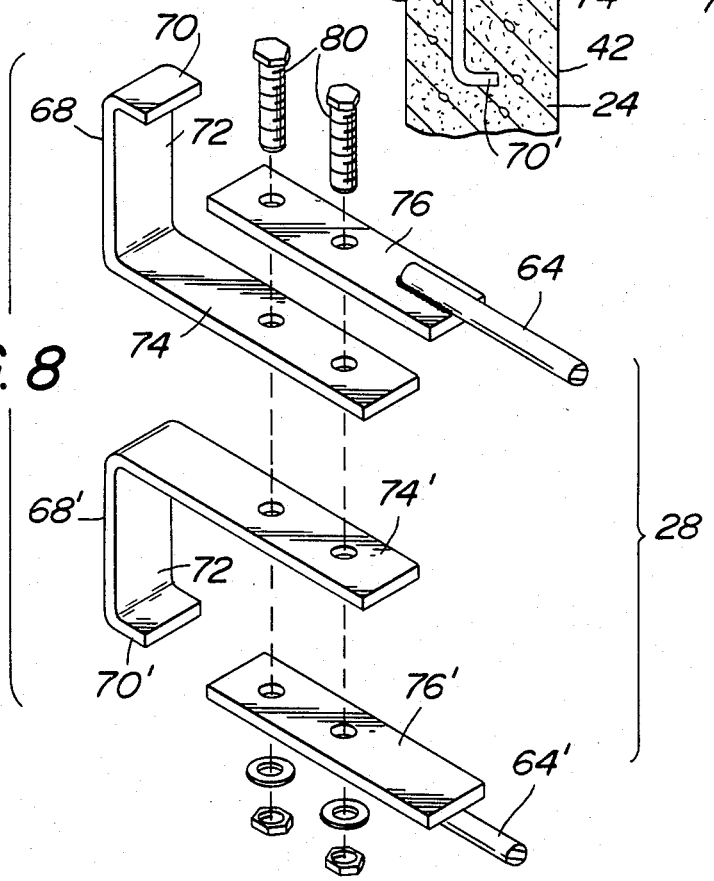
FIG. 8

EARTH RETAINING WALL SYSTEM

BACKGROUND OF THE INVENTION

1. Field of the Invention

This invention relates to earth retaining structural systems. In particular, this invention relates to earth retaining structures which are adapted to allow moisture to pass therethrough while maintaining structural integrity and the capability of maintaining an earth mass in a constrained location. More in particular, this invention relates to structures having a frontal wall formed of modular panels which may easily be removed and repaired or replaced, while not causing a catastrophic failure of the structural system. Still further, this invention relates to earth retaining system structures having a frontal wall which is securely fastened to rear anchor block elements embedded directly in the mass of earth being retained.

2. Prior Art

Earth retaining structures for containing both horizontal and vertical forces are known in the prior art. The best prior art known to the subject inventor is U.S. Pat. No. 4,341,491, which is directed to an earth retaining system utilizing tension bar members for retaining earth within a prescribed volume. Although this type of prior art system is very useful in earth retaining structure systems, it does not provide for a planar frontal wall formed of modular-like panels which may be individually removed or repaired without causing catastrophic failure. Additionally, such prior art like systems do not provide for the plurality of passages, allowing for moisture removal from an earth mass being retained. Still further, such prior art systems do not provide for the plurality of anchor block members which may be directly embedded in the earth mass being retained and coupled to the frontal wall.

Other prior art known to the inventor includes U.S. Pat. Nos. 3,316,721; 2,193,425; 2,138,037; 2,018,920; 1,947,151; 1,937,781; and, 554,680. Additionally, Foreign Patents known to inventor include Belgium Pat. No. 558,564, having a date of Dec., 1957, and French Pat. No. 830,584 having a date of Aug., 1938. These references were all referenced in U.S. Pat. No. 4,341,491 of which this patent application is believed to provide an improvement in earth retaining wall systems.

SUMMARY OF THE INVENTION

An earth retaining wall system which includes a substantially planar frontal wall, including a multiplicity of matingly interfacing panel members. The wall system further includes a plurality of anchor block members which are longitudinally aligned and displaced from the frontal wall panel members. A coupling mechanism is provided for coupling the anchor block members to the frontal wall panel members.

BRIEF DESCRIPTION OF THE DRAWINGS

FIG. 3 is a side view of the earth retaining wall system;

FIG. 4 is a perspective view of an anchor block member showing a fabric liner partially exploded;

FIG. 5 is a sectional view of a pair of frontal panel members taken along the section line 5—5 of FIG. 2;

FIG. 6 is a sectional view of a pair of adjacent frontal panel members taken along the section line 6—6 of FIG. 2;

FIG. 7 is a sectional view of the coupling mechanism taken along the section line 7—7 of FIG. 2; and, FIG. 8 is an exploded perspective view of the coupling mechanism shown in partial cut-away.

DESCRIPTION OF THE PREFERRED EMBODIMENTS

Figure 1:
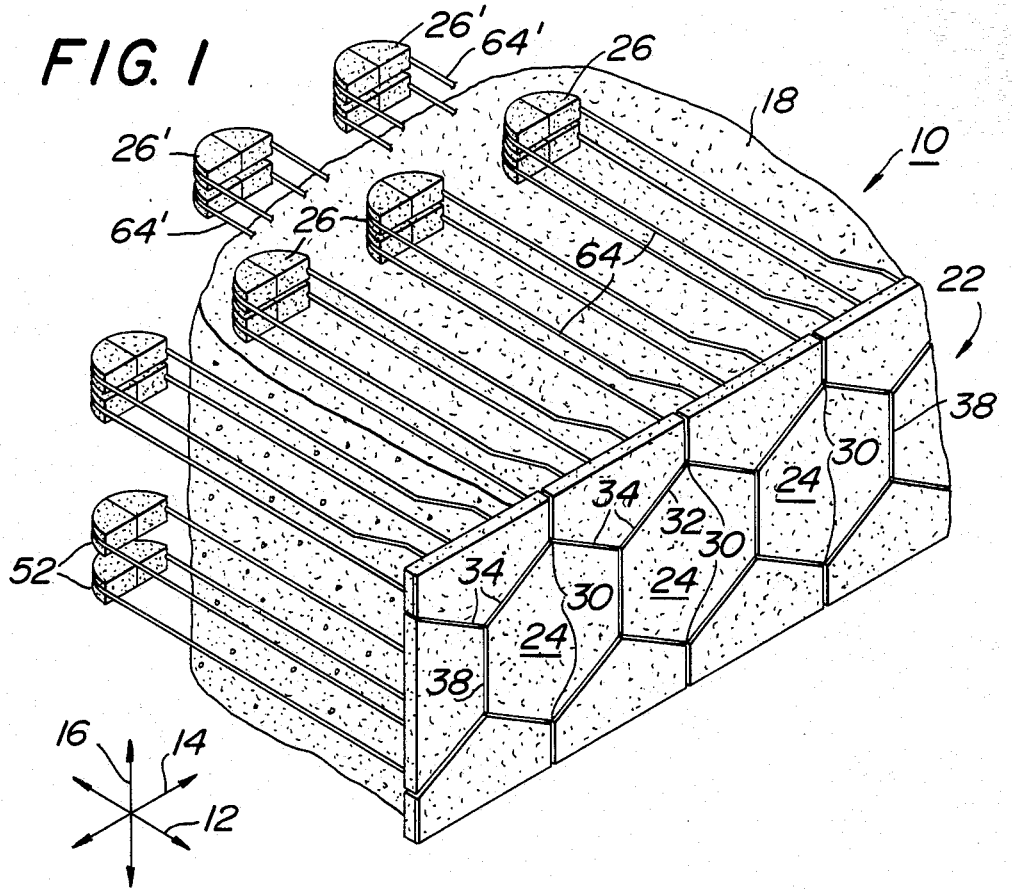
FIG. 1 is a partially exploded perspective view of the earth retaining wall system.
Figure 2:
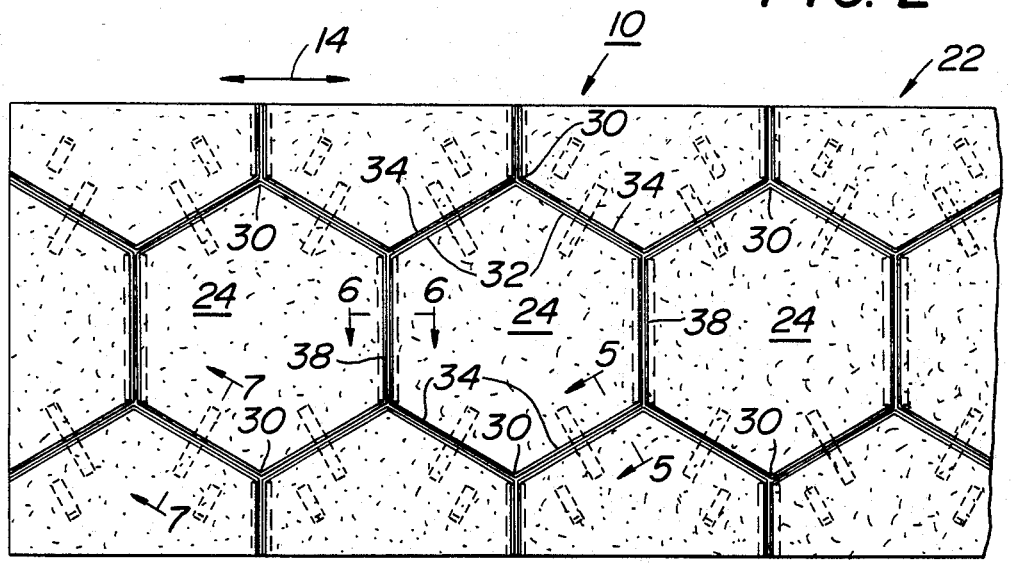
FIG. 2 is a frontal view of the earth retaining wall system showing individual frontal wall panel members.

Referring now to FIGS. 1-3, there is shown earth retaining wall system 10 providing a tension loaded structure similar in the tension loading concept to U.S. Pat. No. 4,341,491. In overall concept, earth retaining wall system 10 is directed to a gravity type structure for maintaining downwardly directed forces in vertical direction 16, as well as to support forces in longitudinal direction 12, either individually or when such forces are taken in combination.

Earth retaining wall system 10 is particularly adaptable for fixedly constraining earth mass 18 to the rear of system 10. Earth retaining wall system 10 prevents displacement of earth mass 18 forward of the constrained mass onto forward base surface 20, as is shown in FIG. 3. In the manner to be described in following paragraphs, system 10 prevents displacement of earth mass 18 which minimizes erosion and other dispersing effects relating to any displacement of earth mass 18.

Additionally, system 10, while maintaining earth mass 18 within a predetermined volume, allows for passage of moisture external to system 10 to further minimize loading forces applied to the constraining elements of system 10 during use. Further, frontal wall 22 of earth retaining wall system 10 as will be shown in following paragraphs, is formed of a plurality of modular elements which may individually be removed from system 10 and possibly replaced with a minimization of costs associated therewith, while maintaining earth mass 18 in the constrained location within system 10.

Earth retaining wall system 10 in general includes substantially planar frontal wall 22 having a multiplicity of matingly interfacing panel members 24. Frontal wall panel members 24 are coupled to anchor block members 26 and 26' through coupling mechanism 28 shown clearly in FIGS. 7 and 8. Anchor block members 26 and 26' are aligned in longitudinal direction 12 with respect to frontal wall panel members 24, and are similarly longitudinally displaced from frontal wall panel members 24, as is clearly seen in FIGS. 1 and 3. Anchor block members 26' are in alignment with anchor block members 26 when taken with respect to the transverse direction 14. FIG. 1 shows an exploded view of anchor block members 26' and does not represent a longitudinal direction 12 displacement between anchor block members 26 and anchor block members 26', but is only shown in the exploded view to provide clarity in following paragraphs, wherein it will be shown that elements of coupling mechanism 28 pass individually to anchor blocks 26 and 26'. For clarity purposes, the separation of anchor blocks 26 and 26' has been shown in the drawings to aid in the description of the elements of earth retaining wall system 10.

Frontal wall 22 includes a plurality of hexagonally contoured frontal wall panel members 24, which are positionally located each with respect to the other in an interfacing manner. Frontal panel members 24 are positionally located each having a pair of opposing apices 30 aligned each with respect to the other in vertical direction 16, as is clearly seen in FIGS. 1 and 2. The positional location of frontal wall panel members 24 in space coordinate relation is important in that the particular alignment of frontal wall panel members 24 provide for force vector loading in a manner which allows removal of one frontal wall panel member 24 from system 10 without a collapse of frontal wall 22.

Hexagonal frontal wall panel members 24 include a pair of upper inclined wall members 32 and a pair of lower inclined wall members 34. Thus, a pair of upper inclined wall sections 32 of a first panel member 24 will extend adjacent a lower inclined wall section or surface 34 of each of a pair of second and third frontal wall panel members 24, as is clearly seen in FIG. 1.

As is evident from FIGS. 1 and 2, it is seen that a force vector loading on frontal wall panel members 24 from other wall panel members in the plane defined by vertical direction 16 and transverse direction 14, will be applied along inclined wall sections 32 and 34. Thus, there is no vector force in a total vertical direction 16 and a removal of one of frontal wall panel members 24 from system 10 will not cause a catastrophic failure of frontal wall 22. In this manner, damage to one of frontal wall members 24 may cause a removal of a particular panel member 24 from system 10 without the disadvantage of having a structural failure of system 10.

Referring now to FIGS. 5 and 7, there is seen to be fabric layer 36 inserted between matingly interfacing inclined wall surfaces 32 and 34 of adjacent wall panel members 24. Fabric layer 36 is formed of a porous type material and may be a polyester fabric composition, or some like formation. Fabric layer 36 may be bonded to upper and lower inclined wall surfaces 32 and 34, or may be maintained therein by gravity assist, not important to the inventive concept as herein described. One important reason for incorporating fabric layer 36 between adjacent and interfacing inclined wall surfaces 32 and 34, is to provide a moisture relief zone in order that any moisture accumulated in earth mass 18 may pass external to wall system 10, thus, minimizing load forces on frontal wall 22.

Each of hexagonally contoured frontal wall panel members 24 further include a pair of vertically directed sidewall surfaces 38 displaced from a next adjacent pair of frontal panel member vertically directed sidewall surfaces 38, as is clearly seen in FIG. 6. Frontal wall 22 includes wall frontal surface 40 and wall rear surface 42 taken in longitudinal direction 12. As seen in FIG. 6, fabric insert member 44 is inserted partially between each pair of displaced vertically directed sidewall surfaces 38. Fabric insert member 44 is secured to wall rear surface 42 of each of adjacent front wall panel members 24, as is seen. Fabric insert member 44 may be adhesively bonded, as shown by element 46, or otherwise secured to rear wall face 42 of panels 24. Fabric insert member 44 is formed of a porous material which allows moisture seepage through opening 48 defined by displaced wall surfaces 38.

As can be seen, fabric insert member 44 includes one piece insert layers 50 extending within through passage 48 in longitudinal direction 12.

Displaced surfaces 38 defining through passage or openings 48 is constructionally advantageous to earth retaining wall system 10. Displacement of opposing surfaces 38 provides for movement or displacement of adjacent wall panels 24 during setting of frontal wall 22 subsequent to construction. Additionally, the porous nature of the polyester fabric insert member 44 allows for passage of moisture through passageway 48, while constraining any earth mass 18 into a constrained location behind rear wall surface 42 of frontal wall 22.

Frontal wall panel members 24 are constructed of a precast concrete composition, which provides for structural integrity sufficient to maintain earth mass 18 in a constrained location without loss of structural integrity to system 10. Although, precast concrete compositions have been used advantageously in earth retaining wall systems 10 of this type, it is to be understood that the particular composition of frontal wall panel members 24 may be formed of other compositions and the precast concrete composition as herein disclosed is illustrative in nature.

Referring to FIGS. 1, 3 and 4, there is shown anchor block members 26 which are semi-cylindrical in contour and include arcuately directed sidewalls 52.

Anchor block members 26 and 26' are displaced from frontal wall 22 in longitudinal direction 12, as is clearly seen. Additionally, each anchor block member 26 or 26' is formed of precast concrete composition, and may be formed in two halves 54 and 56 for ease of forming. Anchor block half members 54 and 56 are joined along interface line 58, shown in FIG. 4 to provide the overall semicylindrical contour of each anchor block member 26 or 26'.

Each anchor block member 26 or 26' includes a releasable securement mechanism for releasably capturing coupling mechanism 28 to each of anchor block members 26 or 26'. The releasable securement mechanism includes grooves 60 formed in arcuately directed sidewall 52 of each of anchor block members 26 or 26'. Insertable within groove 60 is fabric liner 62 which is generally U-shaped in contour and is sandwiched between the surface face of groove 60 and tension bar elements 64 and 64' of coupling mechanism 28.

Fabric liner 62 acts as a cushioning layer between tension bar elements 64 and 64', and the surface of groove 60 of anchor blocks 26 or 26'. It is to be noted that anchor block members 26 or 26' are generally formed of precast concrete compositions and tension bar elements 64 or 64' are formed of a galvanized steel. Thus, if tension bar elements 64 were in direct interface with the surface of groove 60 of anchor blocks 26 or 26', there is the possibility that under force loading, that the coating of tension bar elements 64 may be worn away, causing exposure of tension bar elements 64 or 64' to disadvantageous environmental conditions.

It is to be understood, that anchor blocks 26 and 26' may be directly mounted or embedded in earth mass 18. Thus, as earth 18 is inserted behind frontal wall 22, anchor blocks 26 and 26' may be laid directly on various layers of earth mass 18, as is shown in FIG. 3.

Additionally, as shown in FIG. 3, there may be provided assembly footing 66 which may be formed of concrete, or some like substance, to maintain frontal wall 22 in a substantially vertical direction 16. Such assembly footings 66 are well-known in the art and are not important to the inventive concept as herein described, with the exception that such assembly footings 66 be of sufficient structural integrity to maintain frontal wall 22 in a relatively fixed vertical alignment.

Referring now to FIGS. 1, 7 and 8, coupling mechanism 28 for coupling anchor block members 26 or 26' to frontal wall panel members 24 includes connection plate insert members 68 and 68', embedded in a pair of adjacent frontal wall panel members 24. Each of connection plate insert mexbers 68 or 68' includes an overall L-shaped contour with flange sections 70 and 70' to provide capturing within respective frontal panel members 24.

Each of connection plate insert members 68 and 68' include first leg members 72 and 72', which are embedded and inserted within each of frontal wall panel members 24. Additionally, second leg members 74 and 74' extend in longitudinal direction 12 at the interface between adjacent panel members 24.

Coupling mechanism 28 further includes connection plate members 76 and 76', which are secured to respective connection plate insert members 68 and 68'. Connection plate members 76 and 76' extend in longitudinal direction 12 in a rearward manner when taken with respect to rear surface 42 of frontal wall 22.

Tension bar elements 64 and 64' are secured to respective connection plate members 76 and 76' through welding, such as shown by element 78. Tension bar elements 64 and 64' are formed of galvanized steel rods which extend respectively in longitudinal direction 12 to respective anchor block members 26 and 26'. Thus, tension bar members 64 and 64' are seen to be fixedly secured on one end thereof to a respective connection plate member 76 and 76' with tension bar members 64 and 64' extending in longitudinal direction 12 for releasably coupling to respective anchor block members 26 and 26' by passage around an interfacing insert within grooves 60 of anchor block members 26 or 26'.

Second leg members 74 and 74' of connection plate insert member 68 are bolted through bolts 80 to connection plate members 76 and 76', as is clearly seen in FIG. 7. Additionally, fabric layer 36 is interspaced between second leg members 74 as is shown for the purposes and objectives previously described.

Tension bar member 64 passes around anchor block member 26, and is in constrained relation thereto. Tension bar element 64' passes around a next adjacent anchor block member 26', as is shown in the partially exploded view of FIG. 1. Thus, adjacent tension bar elements 64 and 64' pass around and in contiguous contact with adjacent anchor block members 26 and 26', as is shown in FIG. 1.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or the scope of the invention as defined in the appended claims.

What is claimed is:

1. An earth retaining wall system comprising:

(a) a substantially planar frontal wall including a multiplicity of matingly interfacing panel members including a liquid porous fabric layer inserted between said matingly interfacing panel members for allowing moisture to pass external said wall system;

(b) a plurality of anchor block members longitudinally aligned and displaced from said frontal wall panel members; and, (c) means for coupling said anchor block members to said frontal wall panel members, said means for coupling said anchor block members to said frontal wall panel members including means for securing a pair of matingly adjacent interfacing panel members to a singular anchor block member, said means for securing said pair of matingly interfacing panel members being at least partially embedded within each of said matingly adjacent interfacing panel members.

2. The earth retaining wall system as recited in claim 1 where said frontal wall panel members are hexagonal in contour.

3. The earth retaining wall system as recited in claim 2 where said hexagonally contoured frontal wall panel members are positionally located having a pair of opposing apices aligned each with respect to the other in a vertical direction.

4. The earth retaining wall system as recited in claim 2 where said hexagonal frontal wall panel members include a pair of upper inclined wall members and a pair of lower inclined wall members, said pair of upper inclined wall members of a first panel member extending adjacent one lower inclined wall member of each of a pair of second and third panel members.

5. The earth retaining wall system as recited in claim 4 including said fabric layer being inserted between said matingly interfacing inclined wall members of adjacent wall panel members.

6. The earth retaining wall system as recited in claim 5 where said fabric layer is a polyester fabric composition.

7. The earth retaining wall system as recited in claim 2 where each of said hexagonal frontal wall panel members include a pair of vertically directed sidewall members displaced from a next adjacent pair of frontal panel member vertically directed sidewall members.

8. The earth retaining wall system as recited in claim 7 including a fabric insert member inserted partially between said pair of displaced vertically directed sidewall members, said fabric insert member secured to a rear face of each of said adjacent frontal wall panel members.

9. The earth retaining wall system as recited in claim 8 where said fabric insert member is formed of a polyester composition.

10. The earth retaining wall system as recited in claim 1 where said frontal wall panel members are formed of precast concrete composition members.

11. The earth retaining wall system as recited in claim 1 where said anchor block members are semi-cylindrical in contour, each of said anchor block members having an arcuately directed sidewall member.

12. The earth retaining wall system as recited in claim 11 including releasable securement means for releasably capturing said coupling means to each of said anchor block members.

13. The earth retaining wall system as recited in claim 12 where said releasable securement means includes a groove formed in said arcuately directed sidewall member, said coupling means insertable within said groove of sidewall member.

14. The earth retaining wall system as recited in claim 13 including a fabric strip member sandwiched between an inner surface of said groove of said anchor block member and said coupling means.

15. The earth retaining wall system as recited in claim 11 where said anchor block members are embedded in the earth to be retained.

16. The earth retaining wall system as recited in claim 11 where said anchor block members are formed of a precast concrete composition.

17. The earth retaining wall system as recited in claim 1 where said means for coupling said anchor block member to said frontal wall panel member includes:

(a) at least one connection plate insert member embedded in said frontal wall panel member;

(b) at least one connection plate member secured to said connection plate insert member, said connection plate member extending in said longitudinal direction; and, (c) at least one tension bar member fixedly secured on one end thereof to said connection plate member, said tension bar member extending in said longitudinal direction for releasable coupling to said anchor block member.

18. The earth retaining wall system as recited in claim 17 where said connection plate insert member is L-shaped in contour having a first leg member inserted within said frontal wall panel member and a second leg member extending in said longitudinal direction.

19. The earth retaining wall system as recited in claim 18 where said connection plate insert member second leg member is bolted to said connection plate member.

20. The earth retaining wall system as recited in claim 19 where said tension bar member is welded to said connection plate member.

* * * * *